US006343971B1

(12) United States Patent
Hou

(10) Patent No.: US 6,343,971 B1
(45) Date of Patent: Feb. 5, 2002

(54) CHRISTMAS TREE SHAPED TOY STRUCTURE

(76) Inventor: Chin-Jung Hou, 58, Na Yuan West St., Taichung (TW)

( * ) Notice: Subject to any disclaimer, the term of this patent is extended or adjusted under 35 U.S.C. 154(b) by 8 days.

(21) Appl. No.: 09/653,567

(22) Filed: Aug. 30, 2000

(51) Int. Cl.[7] ..... A63H 13/00
(52) U.S. Cl. ..... 446/358; 446/357; 446/330
(58) Field of Search ..... 446/268, 297, 446/298, 302, 308, 309, 311, 313, 330, 357, 358; 40/406, 409, 410, 411, 414, 418

(56) References Cited

U.S. PATENT DOCUMENTS 4,824,416 A * 4/1989 Chun-Hoi et al. ..... 446/298
5,041,048 A * 8/1991 Lehmann et al. ..... 446/236
5,226,845 A * 7/1993 Wu ..... 446/265
5,442,869 A * 8/1995 McDarren et al. ..... 40/406
5,451,180 A * 9/1995 Chan et al. ..... 446/357
5,556,318 A * 9/1996 So ..... 446/236
5,601,471 A * 2/1997 Kennedy ..... 446/236
5,666,750 A * 9/1997 Segan et al. ..... 40/410
6,200,192 B1 * 3/2001 Hou ..... 446/358
6,210,250 B1 * 4/2001 Sui ..... 446/358

* cited by examiner

*Primary Examiner*—John A. Ricci
*Assistant Examiner*—Fay Francis

(57) ABSTRACT

A Christmas tree shaped toy structure includes a support base, a first actuating set, a scenic base, a second actuating set, a scenic assembly, a housing, and a top hood. The support base includes a hollow support, a battery, and a circular plate. The first actuating set includes a circular first support plate, a circular second support plate, a gear set, and a circular third support plate. The scenic base is secured on the circular plate of the support base for receiving the first actuating set therein. The second actuating set includes a second motor, a second belt gear, a second belt, a plurality of driven gears, an eccentric wheel, two swing arms, and three planetary gears. The scenic assembly includes an annular rack, a curved rotary doll, an annular decorative plate, a circular platform, and two slidable dolls. The housing includes a semi-conic rear hood, and two front hoods. The top hood is secured on the flange of the rear hood of the housing and includes an embedded lamp, and a lighting decoration.

1 Claim, 8 Drawing Sheets

CHRISTMAS TREE SHAPED TOY STRUCTURE

FIELD OF THE INVENTION

The present invention relates to a toy structure, and more particularly to a Christmas tree shaped toy structure.

DESCRIPTION OF THE RELATED ART

A conventional Christmas tree shaped toy sold in the market is commonly used for a child to play with. However, the conventional Christmas tree shaped toy can only provide a monotonous and tedious amusement to the children without a functional variation, and cannot be adapted to have any other utility effect so that such a conventional Christmas tree shaped toy cannot fit the practical requirement in the modern world to attract the children, thereby greatly limiting the versatility of the conventional Christmas tree shaped toy.

SUMMARY OF THE INVENTION

The primary objective of the present invention is to provide a Christmas tree shaped toy structure, wherein the rotary doll and the slide dolls co-operating with the trumpet, the lamp and the lighting decoration can be used to provide an active and lively effect to attract the children so as to increase the amusement effect, thereby enhancing the aesthetic quality and versatility of the toy structure.

In accordance with one aspect of the present invention, there is provided a Christmas tree shaped toy structure comprising: a support base, a first actuating set, a scenic base, a second actuating set, a scenic assembly, a housing, a top hood, and a winding article, wherein, the support base includes:

- a hollow support having a trunk configuration and having a periphery defining a cavity;
- a battery base received in the support and containing a battery therein for providing power supply;
- a switch panel received in the cavity of the support;
- a circular plate secured on a top of the support and defining a central through hole and a trumpet hole located beside the central through hole;
- a trumpet received in the trumpet hole of the circular plate; and
- a sensing member secured on the circular plate and located beside the trumpet;

the first actuating set is mounted on a top of the circular plate of the support base and includes:

- a circular first support plate mounted above the circular plate of the support base, a first motor secured on a bottom of the first support plate and received in the support of the support base through the central through hole of the circular plate of the support base, the first motor having a motor shaft extending through the first support plate and protruding outward therefrom, a plurality of support posts of different lengths secured on a top of the first support plate;
- a circular second support plate secured on the support posts and located above the first support plate, the second support plate defining a circular hole and provided with two opposite short stubs located beside the circular hole;
- a gear set mounted between the first support plate and the second support plate and including:
  - a first belt gear rotatably mounted on the support post of the first support plate;

- a first belt mounted between the first belt gear and the motor shaft of the first motor so that the first belt gear is rotated by the first motor;
  - a first driven gear "A" rotatably mounted on the support post of the first support plate and meshing with the first belt gear to rotate therewith;
  - a second driven gear "B" rotatably mounted on the support post of the first support plate and meshing with the first driven gear "A" to rotate therewith;
  - a third driven gear "C" rotatably mounted on the support post of the first support plate and meshing with the second driven gear "B" to rotate therewith;
  - a fourth driven gear "D" rotatably mounted on the support post of the first support plate and meshing with the third driven gear "C" to rotate therewith;
  - a first multiple-step gear "E" rotatably mounted on the support post of the first support plate and meshing with the fourth driven gear "D" to rotate therewith; and
  - a first secondary gear "El" secured on the first multiple-step gear "E" to rotate therewith and protruding outward from the circular hole of the second support plate;
  - a circular third support plate secured above the second support plate and defining two opposite rectangular holes;
  - two driving levers pivotally mounted between the second support plate and the third support plate, each of the driving levers having a first end provided with a push plate and a second end defining a pivot hole, the push plate defining an elongated oblong hole for slidably receiving the short stub of the second support plate therein, the push plate having one side provided with a plurality of teeth meshing with the first secondary gear "E1 " of the first multiple-step gear "E"; and
  - two trigger switches each secured on the second support plate and each received in the rectangular hole of the third support plate, the two trigger switches located beside the push plate of one of the two driving levers so that the push plate is moved between the two trigger switches to touch and activate one of the two trigger switches;

the scenic base is secured on the circular plate of the support base for receiving the first actuating set therein, and has a periphery defining two radially opposite rectangular slots for allowing passage of the driving lever of the first actuating set, a baffle secured above a mediate portion of the scenic base;

the second actuating set is mounted between the baffle and the scenic base and includes:

- a second motor secured on a bottom of the scenic base and having a motor shaft extending through the scenic base to protrude outward therefrom;
- a second belt gear rotatably mounted on the scenic base;
- a second belt mounted between the second belt gear and the motor shaft of the second motor so that the second belt gear is rotated by the first motor;
- a fifth driven gear "F" rotatably mounted on the scenic base and meshing with the second belt gear to rotate therewith;
- a sixth driven gear "G" rotatably mounted on the scenic base and meshing with the fifth driven gear "F" to rotate therewith;
- a seventh driven gear "H" rotatably mounted on the scenic base and meshing with the sixth driven gear "G" to rotate therewith;

a eighth driven gear "I" rotatably mounted on the scenic base and meshing with the seventh driven gear "H" to rotate therewith;

a ninth driven gear "J" rotatably mounted on the scenic base w and meshing with the eighth driven gear "I" to rotate therewith;

a second multiple-step gear "K" rotatably mounted on the scenic base and meshing with the ninth driven gear "J" to rotate therewith;

an eccentric wheel secured on the second multiple-step gear "K" to rotate therewith, an eccentric shaft eccentrically secured on the eccentric wheel to rotate therewith;

two swing arms pivotally mounted on the scenic base and each having a first end pivotally mounted on the eccentric shaft of the eccentric wheel to move therewith and a second provided with an upright rod; and three planetary gears each rotatably mounted on the scenic base and located outside of the baffle;

the scenic assembly is mounted above the scenic base and the second actuating set and includes:

an annular rack mounted on the scenic base outside of the second actuating set and meshing with the second multiple-step gear "K" and the three planetary gears to rotate therewith, a plurality of positioning stubs secured on a periphery of the annular rack to rotate therewith;

a curved rotary doll secured on the annular rack to rotate therewith and defining a plurality of positioning holes for securing the positioning stubs of the annular rack therein;

an annular decorative plate secured on the scenic base and located outside of the annular rack, the decorative plate having a periphery defining a plurality of screw holes co-operating with a plurality of threaded locking members for securing the decorative plate to the scenic base;

a circular platform secured on the scenic base for enclosing the second actuating set and located inside of the annular rack, the platform defining two substantially S-shaped guide slots for slidably receiving the upright rod of each of the two swing arms of the second actuating set therein, a plurality of threaded posts each secured on a bottom of the platform for securing the platform to the scenic base; and two slidable dolls each slidably mounted on the platform and each having a bottom defining a fitting hole, two fitting rings each secured in the fitting hole of each of the two slidable dolls and each fitted on the upright rod of each of the two swing arms of the second actuating set so that each of the two slidable dolls is secured on the upright rod of each of the two swing arms of the second actuating set to slide therewith;

the housing is mounted above the scenic base for fitting of the winding article and includes:

a semi-conic rear hood secured on the scenic base and having a top provided with a flange, the rear hood having two opposite sides each having an upper portion and a lower portion each provided with a first pivot ear; and two front hoods pivotally mounted on the two opposite sides of the rear hood to form an entire hollow cone, each of the two front hoods having one side having an upper portion and a lower portion each provided with two spaced second pivot ears for receiving the first pivot ear of the rear hood therebetween, a plurality of latch rods each extending through the second pivot ears of each of the two front hoods and through the first pivot ear of the rear hood so that each of the two front hoods is pivotally mounted on the rear hood, the second pivot ear located at the lower portion of each of the two front hoods having a bottom secured with a linking lever which has a distal end pivotally mounted on the second end of each of the two driving levers of the first actuating set; and the top hood is cone-shaped and has a bottom secured on the flange of the rear hood of the housing, the top hood has an outer periphery provided with a plurality of elongated ribs each defining a plurality of holes for allowing passage of the winding article, an embedded lamp mounted in the top hood, and a lighting decoration mounted on a top of the top hood.

Further benefits and advantages of the present invention will become apparent after a careful reading of the detailed description with appropriate reference to the accompanying drawings.

DETAILED DESCRIPTION OF THE INVENTION

Figure 1:
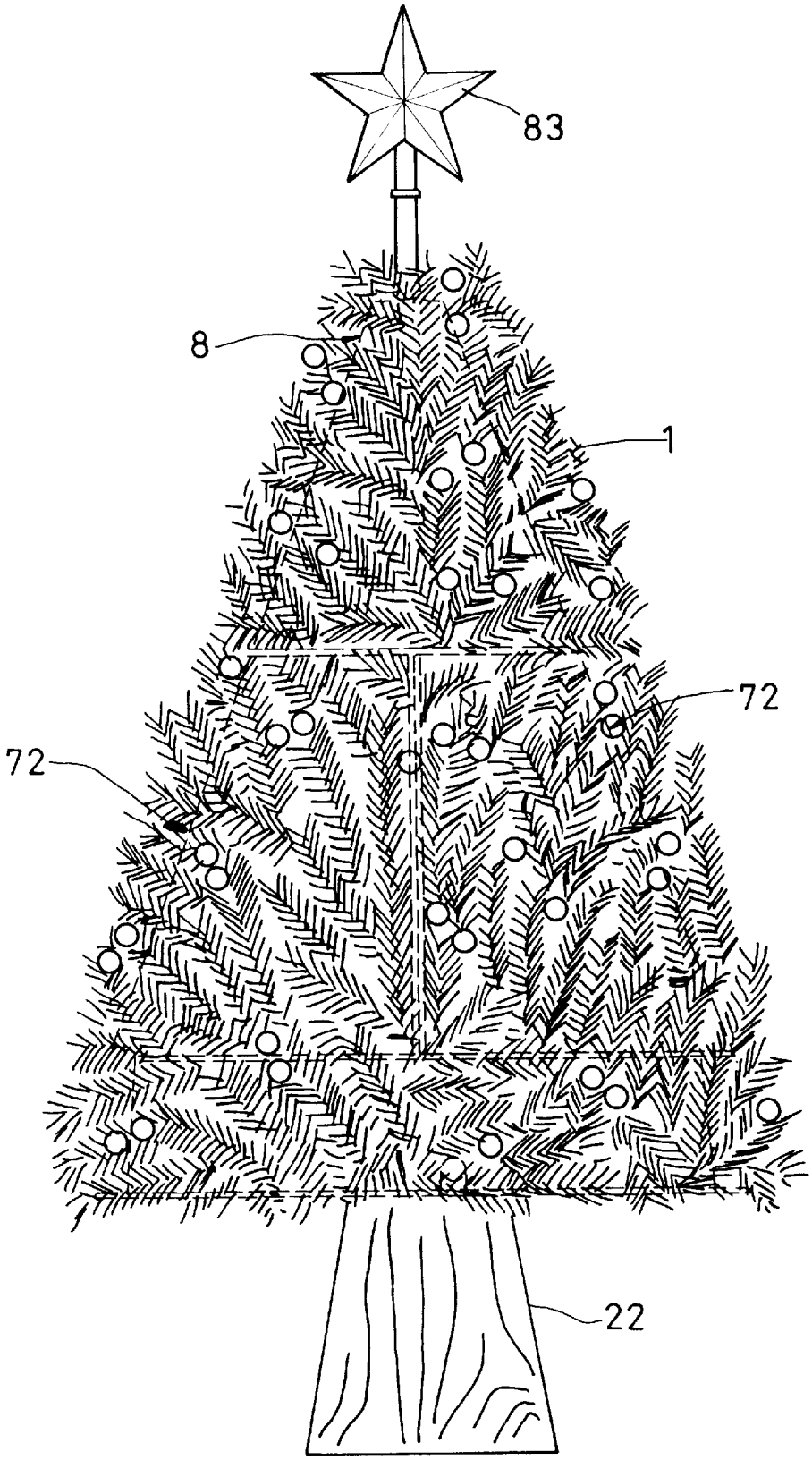
FIG. 1 is a schematic view of a Christmas tree shaped toy structure in accordance with the present invention.
Figure 2:
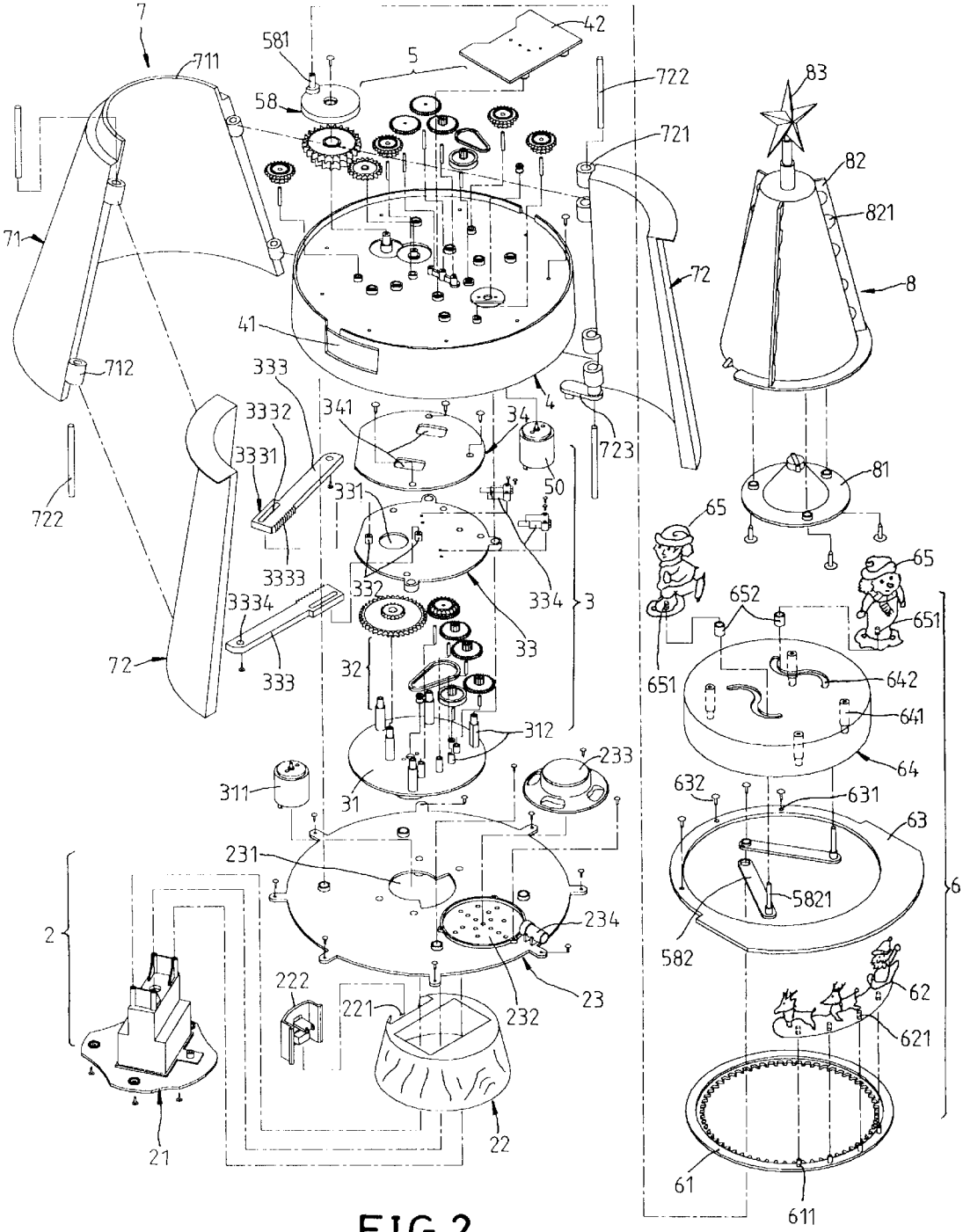
FIG. 2 is an exploded view of the toy structure as shown in FIG. 1.
Figure 3:
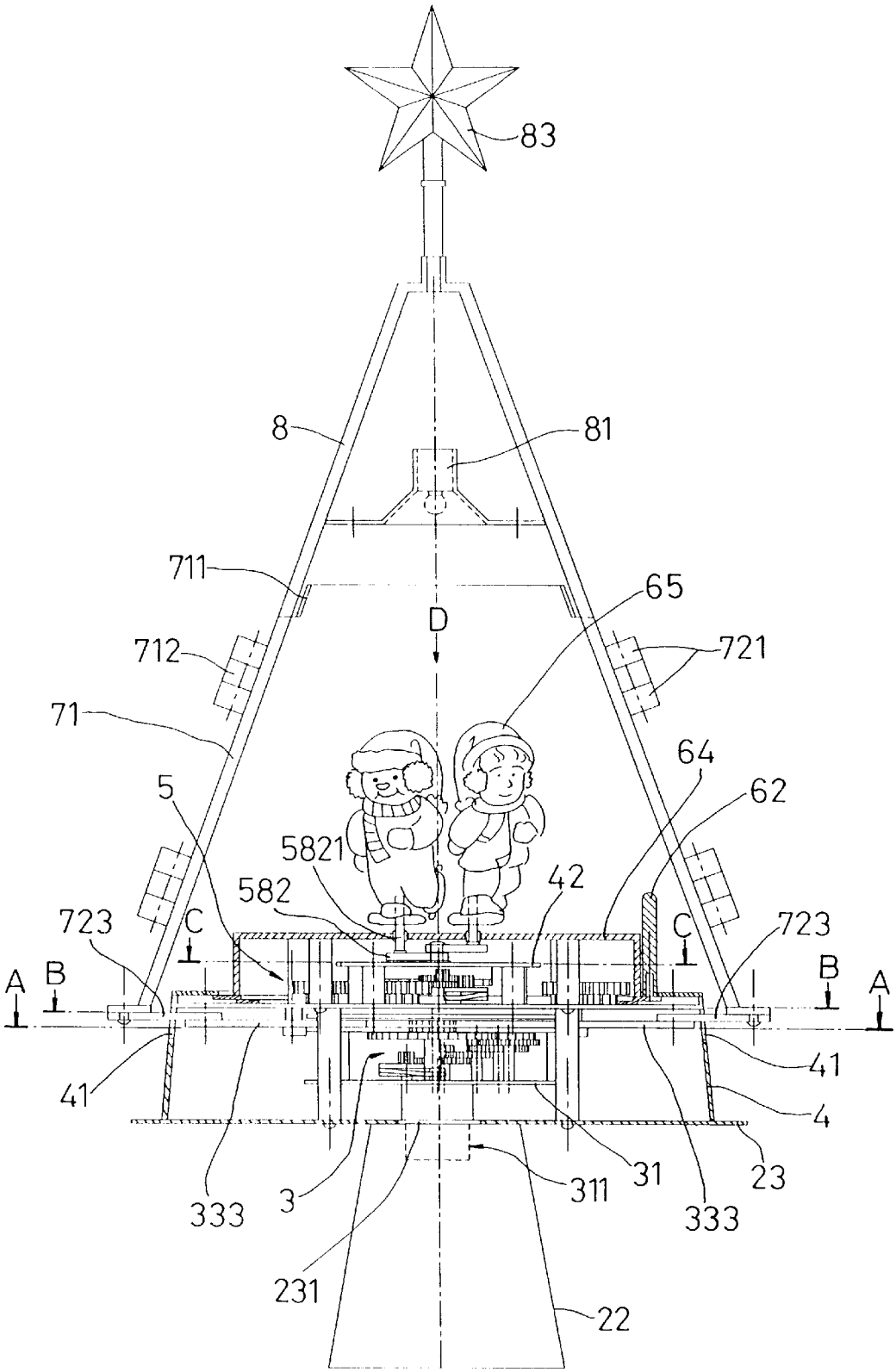
FIG. 3 is a front plan cross-sectional assembly view of the toy structure as shown in FIG. 2.

Referring to the drawings and initially to FIGS. 1–3, a Christmas tree shaped toy structure in accordance with the present invention comprises a support base 2, a first actuating set 3, a scenic base 4, a second actuating set 5, a scenic assembly 6, a housing 7, a top hood 8, and a winding article 1 wound around the housing 7 and the top hood 8.

The support base 2 includes: a hollow support 22 having a trunk configuration and having a periphery defining a cavity 221, a battery base 21 received in the support 22 and containing a battery therein for providing power supply, a switch panel 222 received in the cavity 221 of the support 22, a circular plate 23 secured on a top of the support 22 and defining a central through hole 231 and a trumpet hole 232 located beside the central through hole 231, a trumpet 233 received in the trumpet hole 232 of the circular plate 23, and a sensing member 234 secured on the circular plate 23 and located beside the trumpet 233.

The first actuating set 3 is mounted on a top of the circular plate 23 of the support base 2 and includes: a circular first support plate 31, a gear set 32, a circular second support plate 33, and a circular third support plate 34.

The circular first support plate 31 is mounted above the circular plate 23 of the support base 2. A first motor 311 is secured on the bottom of the first support plate 31 and is received in the support 22 of the support base 2 through the central through hole 231 of the circular plate 23 of the support base 2. The first motor 311 has a motor shaft extending through the first support plate 31 and protruding outward. A plurality of support posts 312 of different lengths are secured on the top of the first support plate 31.

The circular second support plate 33 is secured on the support posts 312 and is located above the first support plate 31. The second support plate 33 defines a circular hole 331 and is provided with two opposite short stubs 332 located beside the circular hole 331.

Figure 4:
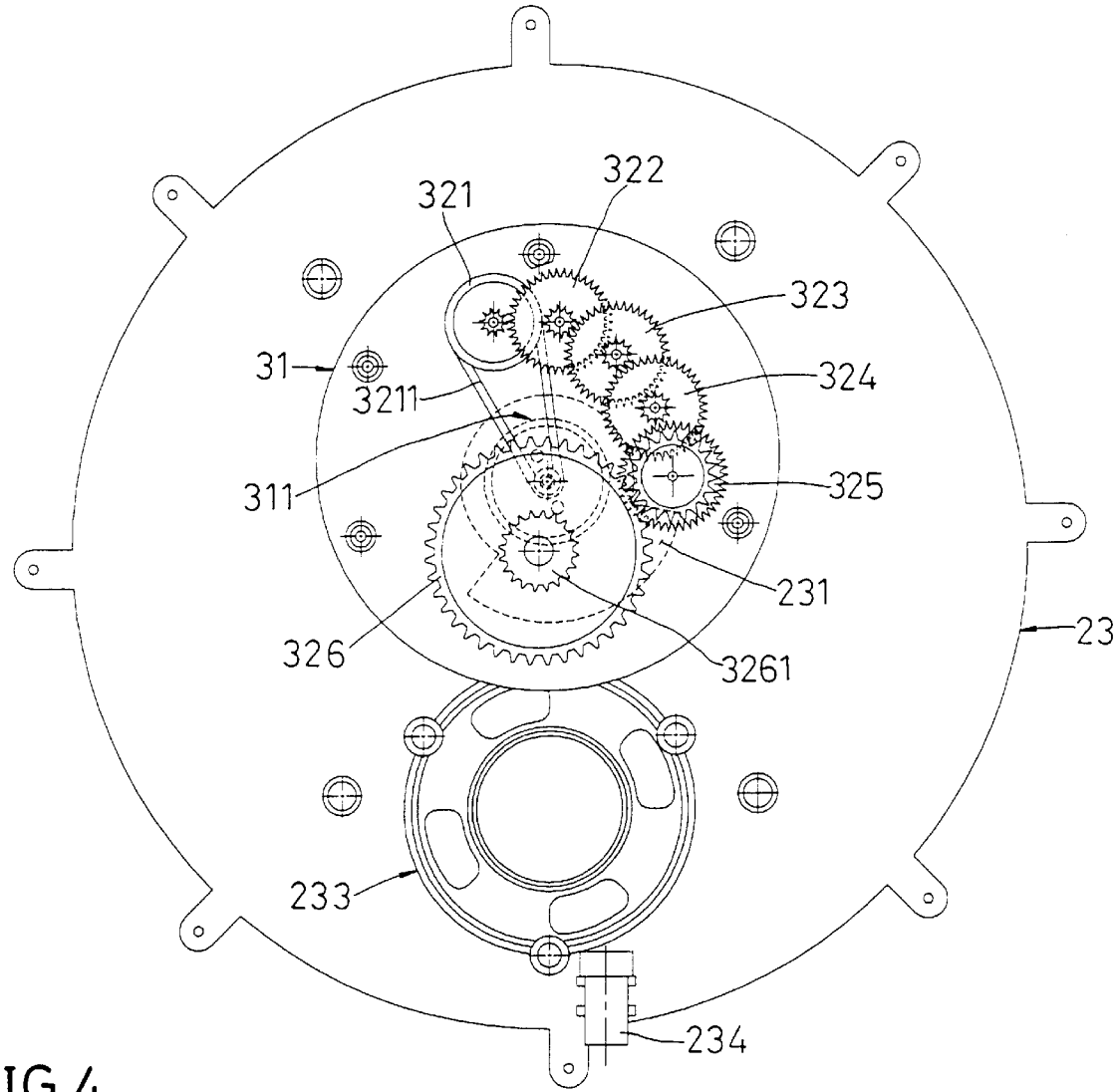
FIG. 4 is a top plan assembly view of a first actuating set of the toy structure as shown in FIG. 2.

Referring to FIG. 4 with reference to FIGS. 2 and 3, the gear set 32 is mounted between the first support plate 31 and the second support plate 33 and includes: a first belt gear 321 rotatably mounted on the support post 312 of the first support plate 31, a first belt 3211 mounted between the first belt gear 321 and the motor shaft of the first motor 311 so that the first belt gear 321 is rotated by the first motor 311, a first driven gear "A" 322 rotatably mounted on the support post 312 of the first support plate 31 and meshing with the first belt gear 321 to rotate therewith, a second driven gear "B" 323 rotatably mounted on the support post 312 of the first support plate 31 and meshing with the first driven gear "A" 322 to rotate therewith, a third driven gear "C" 324 rotatably mounted on the support post 312 of the first support plate 31 and meshing with the second driven gear "B" 323 to rotate therewith, a fourth driven gear "D" 325 rotatably mounted on the support post 312 of the first support plate 31 and meshing with the third driven gear "C" 324 to rotate therewith, a first multiple-step gear "E" 326 rotatably mounted on the support post 312 of the first support plate 31 and meshing with the fourth driven gear "D" 325 to rotate therewith, and a first secondary gear "E1" 3261 secured on the first multiple-step gear "E" 326 to rotate therewith and protruding outward from the circular hole 331 of the second support plate 33.

The circular third support plate 34 is secured above the second support plate 33 and defines two opposite rectangular holes 341.

Figure 5:
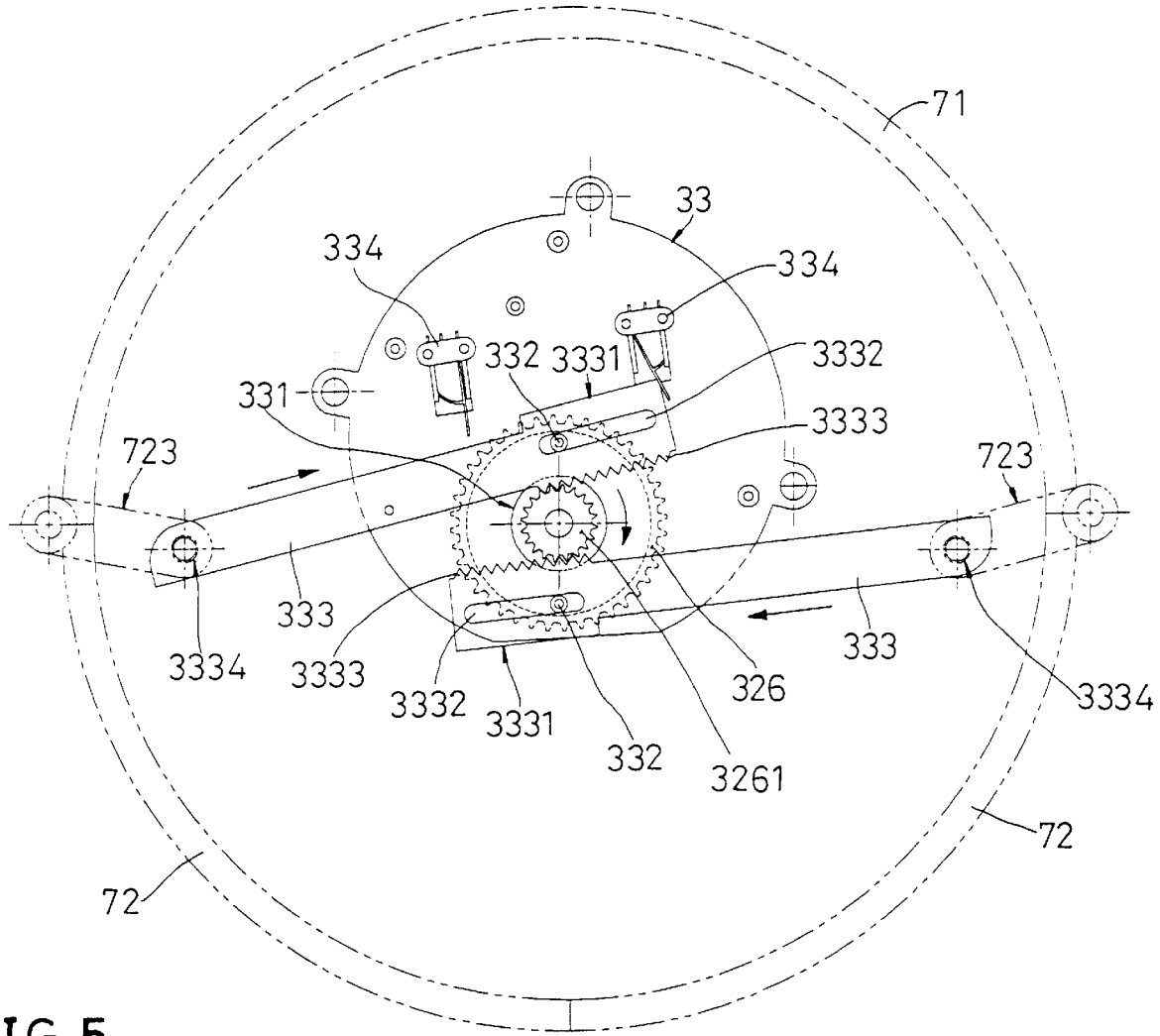
FIG. 5 is a top plan assembly view of the first actuating set of the toy structure as shown in FIG. 2.

Referring to FIG. 5 with reference to FIGS. 2 and 3, two driving levers 333 are pivotally mounted between the second support plate 33 and the third support plate 34. Each of the driving levers 333 has a first end provided with a push plate 3331 and a second end defining a pivot hole 3334. The push plate 3331 defines an elongated oblong hole 3332 for slidably receiving the short stub 332 of the second support plate 33 therein. The push plate 3331 has one side provided with a plurality of teeth 3333 meshing with the first secondary gear "E1" 3261 of the first multiple-step gear "E" 326.

Two trigger switches 334 are each secured on the second support plate 33 and are each received in the rectangular hole 341 of the third support plate 34. The two trigger switches 334 are located beside the push plate 3331 of one of the two driving levers 333 so that the push plate 3331 is moved between the two trigger switches 334 so as to touch and activate one of the two trigger switches 334.

The scenic base 4 is secured on the circular plate 23 of the support base 2 for receiving the first actuating set 3 and has a periphery defining two radially opposite rectangular slots 41 for allowing passage of the driving lever 333 of the first actuating set 3. A baffle 42 is secured above a mediate portion of the scenic base 4.

Figure 6:
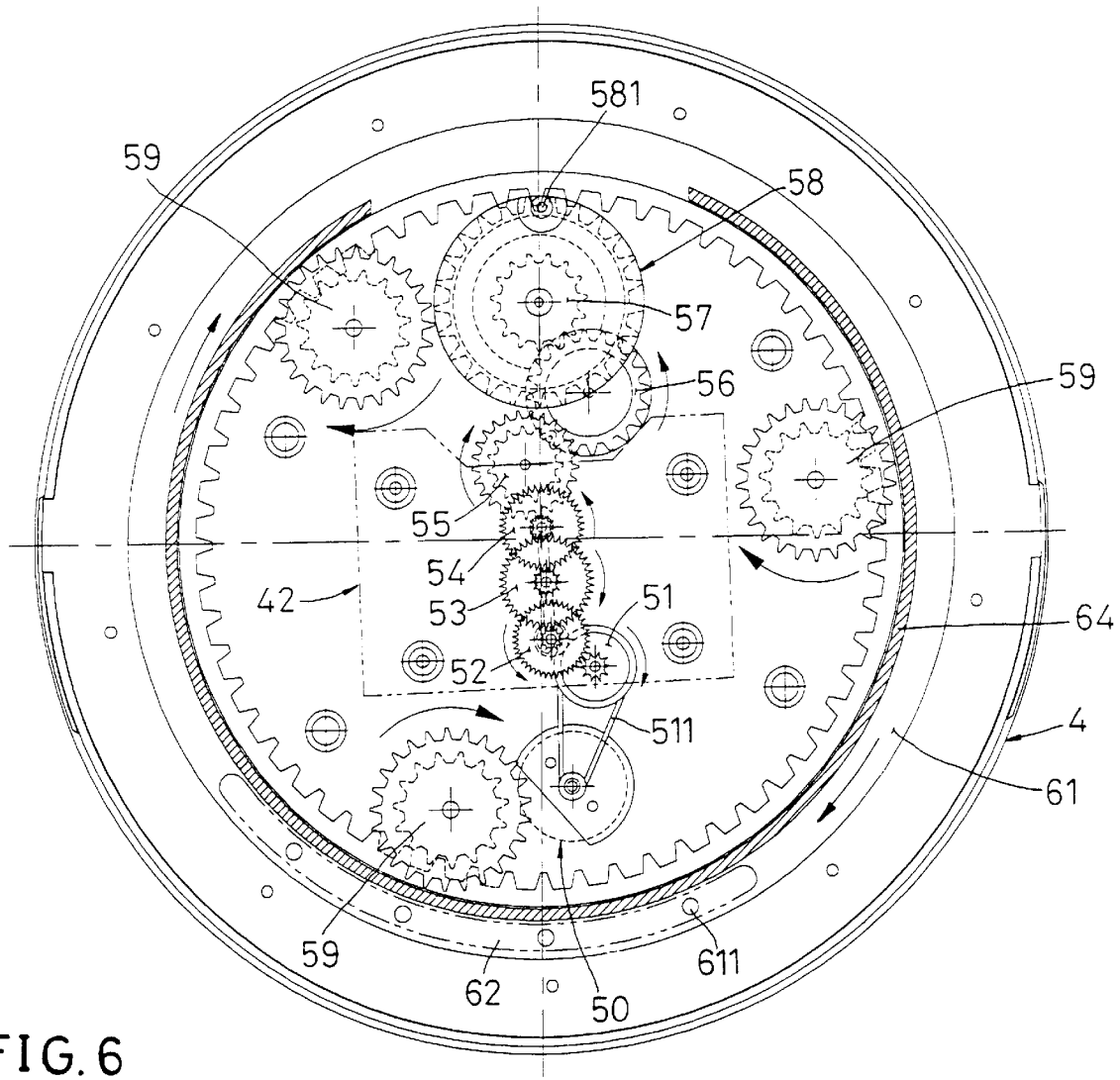
FIG. 6 is a top plan assembly view of a second actuating set of the toy structure as shown in FIG. 2.
Figure 7:
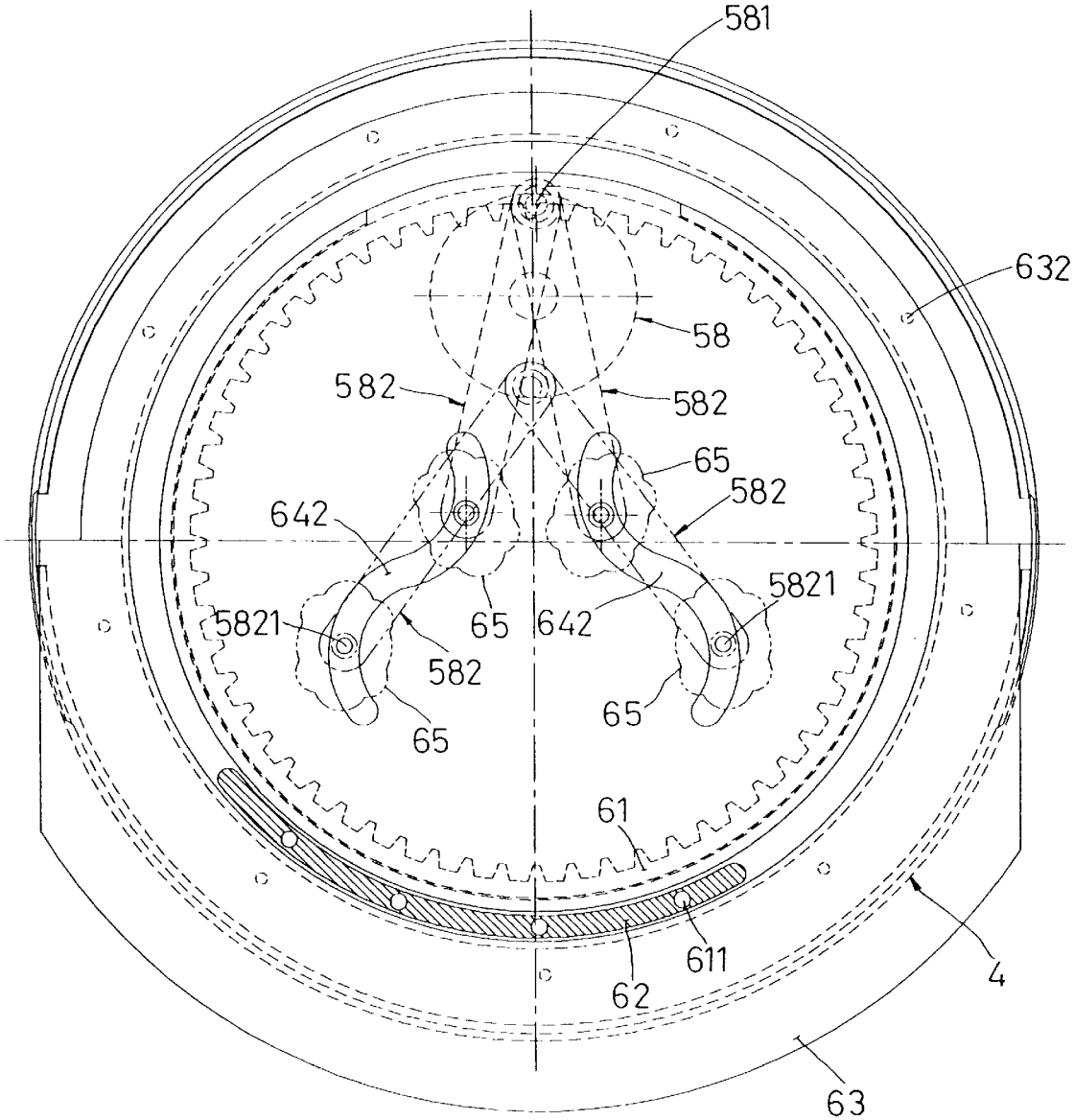
FIG. 7 is a top plan assembly view of the second actuating set of the toy structure as shown in FIG. 2.

Referring to FIGS. 6 and 7 with reference to FIGS. 2 and 3, the second actuating set 5 is mounted between the baffle 42 and the scenic base 4 and includes: a second motor 50 secured on a bottom of the scenic base 4 and having a motor shaft extending through the scenic base 4 to protrude outward therefrom, a second belt gear 51 rotatably mounted on the scenic base 4, a second belt 511 mounted between the second belt gear 51 and the motor shaft of the second motor 50 so that the second belt gear 51 is rotated by the first motor 50, a fifth driven gear "F" 52 rotatably mounted on the scenic base 4 and meshing with the second belt gear 51 to rotate therewith, a sixth driven gear "G" 53 rotatably mounted on the scenic base 4 and meshing with the fifth driven gear "F" 52 to rotate therewith, a seventh driven gear "H" 54 rotatably mounted on the scenic base 4 and meshing with the sixth driven gear "G" 53 to rotate therewith, a eighth driven gear "I" 55 rotatably mounted on the scenic base 4 and meshing with the seventh driven gear "H" 54 to rotate therewith, a ninth driven gear "J" 56 rotatably mounted on the scenic base 4 and meshing with the eighth driven gear "I" 55 to rotate therewith, a second multiple-step gear "K" 57 rotatably mounted on the scenic base 4 and meshing with the ninth driven gear "J" 56 to rotate therewith, an eccentric wheel 58 secured on the second multiple-step gear "K" 57 to rotate therewith, an eccentric shaft 581 eccentrically secured on the eccentric wheel 58 to rotate therewith, two swing arms 582 pivotally mounted on the scenic base 4 and each having a first end pivotally mounted on the eccentric shaft 581 of the eccentric wheel 58 to move therewith and a second provided with an upright rod 5821, and three planetary gears 59 each rotatably mounted on the scenic base 4 and located outside of the baffle 42.

The scenic assembly 6 is mounted above the scenic base 4 and the second actuating set 5 and includes: an annular rack 61, a curved rotary doll 62, an annular decorative plate 63, a circular platform 64, and two slidable dolls 65.

The annular rack 61 is mounted on the scenic base 4 outside of the second actuating set 5 and meshes with the second multiple-step gear "K" 57 and the three planetary gears 59 to rotate therewith. A plurality of positioning stubs 611 are secured on the periphery of the annular rack 61 to rotate therewith.

The curved rotary doll 62 is secured on the annular rack 61 to rotate therewith and defines a plurality of positioning holes 621 for securing the positioning stubs 611 of the annular rack 61 therein.

The annular decorative plate 63 is secured on the scenic base 4 and is located outside of the annular rack 61. The decorative plate 63 has a periphery defining a plurality of screw holes 631 co-operating with a plurality of threaded locking members 632 for securing the decorative plate 63 to the scenic base 4.

The circular platform 64 is secured on the scenic base 4 for enclosing the second actuating set 5 and is located inside of the annular rack 61. The platform 64 defines two substantially S-shaped guide slots 642 for slidably receiving the upright rod 5821 of each of the two swing arms 582 of the second actuating set 5 therein. A plurality of threaded posts 641 are each secured on the bottom of the platform 64 for securing the platform 64 to the scenic base 4.

The two slidable dolls 65 are each slidably mounted on the platform 64 and each have a bottom defining a fitting hole 651. Two fitting rings 652 are each secured in the fitting hole 651 of each of the two slidable dolls 65 and are each fitted on the upright rod 5821 of each of the two swing arms 582 of the second actuating set 5 so that each of the two slidable dolls 65 is secured on the upright rod 5821 of each of the two swing arms 582 of the second actuating set 5 to slide therewith.

Figure 8:
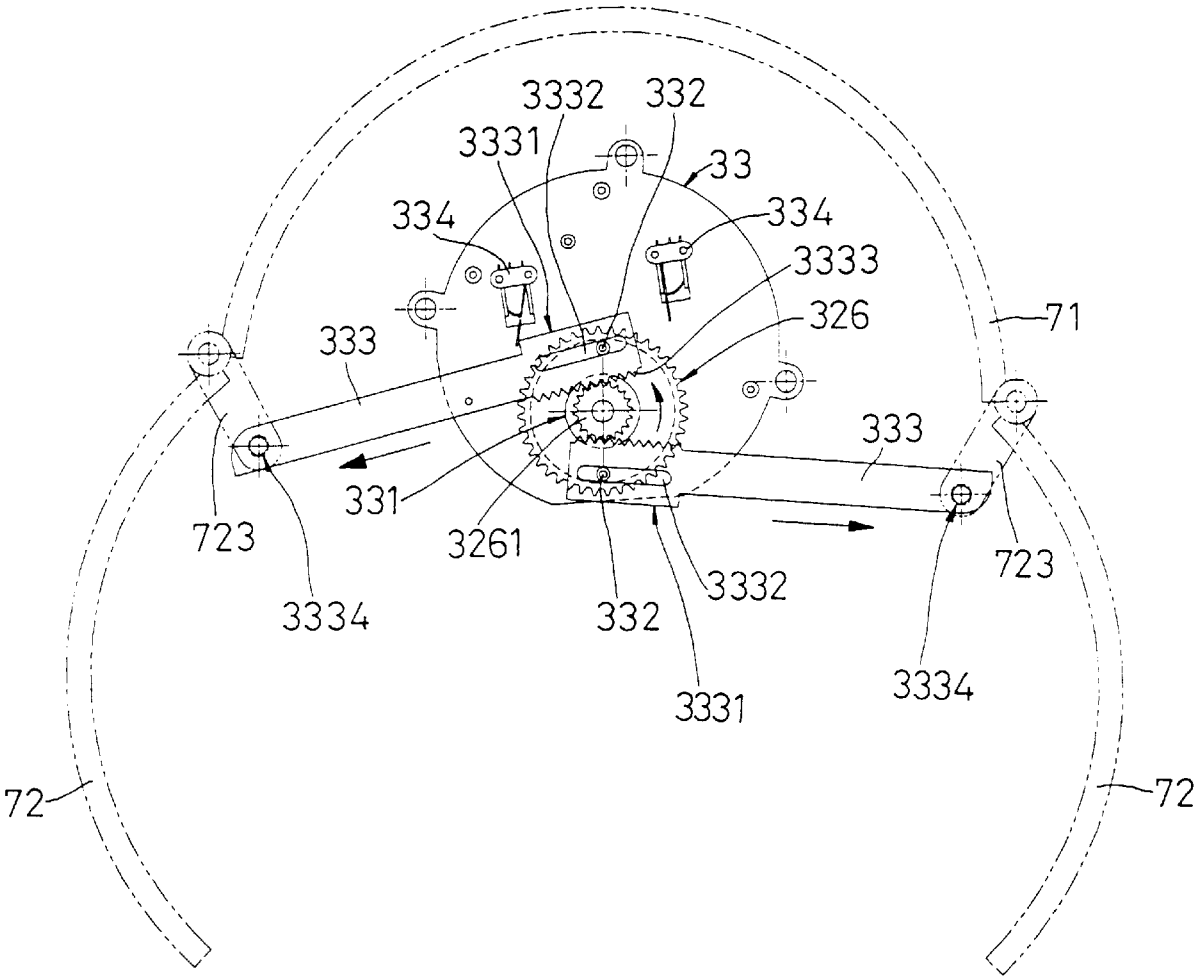
FIG. 8 is an operational view of the first actuating set of the toy structure as shown in FIG. 5.

Referring to FIG. 8 with reference to FIGS. 2 and 3, the housing 7 is mounted above the scenic base 4 for fitting of the winding article 1 and includes: a semi-conic rear hood 71, and two front hoods 72.

The semi-conic rear hood 71 is secured on the scenic base 4 and has a top provided with a flange 711. The rear hood 71 has two opposite sides each having an upper portion and a lower portion each provided with a first pivot ear 712.

The two front hoods 72 are pivotally mounted on the two opposite sides of the rear hood 71 to form an entire hollow cone. Each of the two front hoods 72 has one side having an upper portion and a lower portion each provided with two spaced second pivot ears 721 for receiving the first pivot ear 712 of the rear hood 71 therebetween. A plurality of latch rods 722 each extend through the second pivot ears 721 of each of the two front hoods 72 and through the first pivot ear 712 of the rear hood 71 so that each of the two front hoods 72 is pivotally mounted on the rear hood 71. The second pivot ear 721 located at the lower portion of each of the two front hoods 72 has a bottom secured with a linking lever 723 which has a distal end pivotally mounted on the pivot hole 3334 of the second end of each of the two driving levers 333 of the first actuating set 3.

The top hood 8 is cone-shaped and has a bottom secured on the flange 711 of the rear hood 71 of the housing 7. The top hood 8 has an outer periphery provided with a plurality of elongated ribs 82 each defining a plurality of holes 821 for allowing passage of the winding article 1. An embedded lamp 81 is mounted in the top hood 8, and a lighting decoration 83 is mounted on a top of the top hood 8.

In operation, referring to FIGS. 1–8, when the sensing member 234 of the support base 2 detects an object located in front of it, the first motor 311 of the first actuating set 3 is operated to rotate the belt wheel 321 through the belt 3211 as shown in FIG. 4, thereby in turn rotating the driven gear "A" 322, the driven gear "B" 323, the driven gear "C" 324, and the driven gear "D" 325 which then rotates the multi-step gear "E" 326 which rotates the secondary gear "E1" 3261 which meshes with the teeth 3333 of the driving levers 333 so as to move each of the two driving levers 333 outward from the position as shown in FIG. 5 to the position as shown in FIG. 8, thereby pivoting the linking levers 723 which push the two front hoods 72 to rotate outward, thereby opening the housing 7.

When the push plate 3331 of one of the driving levers 333 touches one of the two trigger switches 324, the trigger switch 324 operates to stop rotation of the first motor 311 of the first actuating set 3 so that the two front hoods 72 are maintained at an open state.

At the same time, the trumpet 233 contained in the support base 2 emits music, and the embedded lamp 81 and the lighting decoration 83 of the top hood 8 also light, thereby enhancing the audio and video effects.

At the same time, the trigger switch 334 emits a signal to operate the second motor 50 of the second actuating set 5 to rotate the belt gear 51 through the belt 511 as shown in FIG. 6, thereby in turn rotating the driven gear "F" 52, the driven gear "G" 53, the driven gear "H" 54, the driven gear "I" 55, and the driven gear "J" 56 which then rotates the multi-step gear "K" 57 which rotates the annular rack 61 which rotates the three planetary gears 59 whereby the rotary doll 62 is rotated with the annular rack 61 so that the rotary doll 62 is moved to run around the platform 64.

At the same time, the eccentric wheel 58 is rotated with the multi-step gear "K" 57 to rotate the eccentric shaft 581 which moves the two swing arms 582 which move the upright rods 5821 which are limited to slide in the guide slots 642 as shown in FIG. 7 so that the two slide dolls 65 are moved on the platform 64 along the guide slots 642.

When the rotary doll 62 and the slide dolls 65 are operated during a determined period of time, the second motor 50 of the second actuating set 5 stops operating so as to stop movement of the rotary doll 62 and the slide dolls 65. Then, the first motor 311 of the first actuating set 3 is operated to rotate in a reverse direction to move each of the two driving levers 333 inward from the position as shown in FIG. 8 to the position as shown in FIG. 5, thereby pivoting the linking levers 723 which push the two front hoods 72 to rotate inward, thereby closing the housing 7.

Accordingly, the toy structure of the present invention has the following advantages.

The rotary doll 62 and the slide dolls 65 co-operating with the trumpet 233, the embedded lamp 81 and the lighting decoration 83 can be used to provide an active and lively effect to attract the children so as to increase the amusement effect, thereby enhancing the aesthetic quality and versatility of the toy structure.

It should be clear to those skilled in the art that further embodiments may be made without departing from the scope of the present invention.

What is claimed is:

1. A Christmas tree shaped toy structure comprising:

a support base (2), a first actuating set (3), a scenic base (4), a second actuating set (5), a scenic assembly (6), a housing (7), a top hood (8), and a winding article (1), wherein, said support base (2) includes:

a hollow support (22) having a trunk configuration and having a periphery defining a cavity (221);

a battery base (21) received in said support (22) and containing a battery therein for providing power supply;

a switch panel (222) received in said cavity (221) of said support (22);

a circular plate (23) secured on a top of said support (22) and defining a central through hole (231) and a trumpet hole (232) located beside said central through hole (231);

a trumpet (233) received in said trumpet hole (232) of said circular plate (23); and a sensing member (234) secured on said circular plate (23) and located beside said trumpet (233);

said first actuating set (3) is mounted on a top of said circular plate (23) of said support base (2) and includes:

a circular first support plate (31) mounted above said circular plate (23) of said support base (2), a first motor (311) secured on a bottom of said first support plate (31) and received in said support (22) of said support base (2) through said central through hole (231) of said circular plate (23) of said support base (2), said first motor (311) having a motor shaft extending through said first support plate (31) and protruding outward therefrom, a plurality of support posts (312) of different lengths secured on a top of said first support plate (31);

a circular second support plate (33) secured on said support posts (312) and located above said first support plate (31), said second support plate (33) defining a circular hole (331) and provided with two opposite short stubs (332) located beside said circular hole (331);

a gear set (32) mounted between said first support plate (31) and said second support plate (33) and including:

a first belt gear (321) rotatably mounted on said support post (312) of said first support plate (311);

a first belt (3211) mounted between said first belt gear (321) and said motor shaft of said first motor (311) so that said first belt gear (321) is rotated by said first motor (311);

a first driven gear "A" (322) rotatably mounted on said support post (312) of said first support plate (31) and meshing with said first belt gear (321) to rotate therewith;

a second driven gear "B" (323) rotatably mounted on said support post (312) of said first support plate (31) and meshing with said first driven gear "A" (322) to rotate therewith;

a third driven gear "C" (324) rotatably mounted on said support post (312) of said first support plate (31) and meshing with said second driven gear "B" (323) to rotate therewith;

a fourth driven gear "D" (325) rotatably mounted on said support post (312) of said first support plate (31) and meshing with said third driven gear "C" (324) to rotate therewith;

a first multiple-step gear "E" (326) rotatably mounted on said support post (312) of said first support plate (31) and meshing with said fourth driven gear "D" (325) to rotate therewith; and a first secondary gear "E1" (3261) secured on said first multiple-step gear "E" (326) to rotate therewith and protruding outward from said circular hole (331) of said second support plate (33);

a circular third support plate (34) secured above said second support plate (33) and defining two opposite rectangular holes (341);

two driving levers (333) pivotally mounted between said second support plate (33) and said third support plate (34), each of said driving levers (333) having a first end provided with a push plate (3331) and a second end defining a pivot hole (3334), said push plate (3331) defining an elongated oblong hole (3332) for slidably receiving said short stub (332) of said second support plate (33) therein, said push plate (3331) having one side provided with a plurality of teeth (3333) meshing with said first secondary gear "E1" (3261) of said first multiple-step gear "E" (326); and two trigger switches (334) each secured on said second support plate (33) and each received in said rectangular hole (341) of said third support plate (34), said two trigger switches (334) located beside said push plate (3331) of one of said two driving levers (333) so that said push plate (3331) is moved between said two trigger switches (334) to touch and activate one of said two trigger switches (334);

said scenic base (4) is secured on said circular plate (23) of said support base (2) for receiving said first actuating set (3) therein, and has a periphery defining two radially opposite rectangular slots (41) for allowing passage of said driving lever (333) of said first actuating set (3), a baffle (42) secured above a mediate portion of said scenic base (4);

said second actuating set (5) is mounted between said baffle (42) and said scenic base (4) and includes:

a second motor (50) secured on a bottom of said scenic base (4) and having a motor shaft extending through said scenic base (4) to protrude outward therefrom;

a second belt gear (51) rotatably mounted on said scenic base (4);

a second belt (511) mounted between said second belt gear (51) and said motor shaft of said second motor (50) so that said second belt gear (51) is rotated by said first motor (50);

a fifth driven gear "F" (52) rotatably mounted on said scenic base (4) and meshing with said second belt gear (51) to rotate therewith;

a sixth driven gear "G" (53) rotatably mounted on said scenic base (4) and meshing with said fifth driven gear "F" (52) to rotate therewith;

a seventh driven gear "H" (54) rotatably mounted on said scenic base (4) and meshing with said sixth driven gear "G" (53) to rotate therewith;

a eighth driven gear "I" (55) rotatably mounted on said scenic base (4) and meshing with said seventh driven gear "H" (54) to rotate therewith;

a ninth driven gear "J" (56) rotatably mounted on said scenic base (4) and meshing with said eighth driven gear "I" (55) to rotate therewith;

a second multiple-step gear "K" (57) rotatably mounted on said scenic base (4) and meshing with said ninth driven gear "J" (56) to rotate therewith;

an eccentric wheel (58) secured on said second multiple-step gear "K" (57) to rotate therewith, an eccentric shaft (581) eccentrically secured on said eccentric wheel (58) to rotate therewith;

two swing arms (582) pivotally mounted on said scenic base (4) and each having a first end pivotally mounted on said eccentric shaft (581) of said eccentric wheel (58) to move therewith and a second provided with an upright rod (5821); and three planetary gears (59) each rotatably mounted on said scenic base (4) and located outside of said baffle (42);

said scenic assembly (6) is mounted above said scenic base (4) and said second actuating set (5) and includes:

an annular rack (61) mounted on said scenic base (4) outside of said second actuating set (5) and meshing with said second multiple-step gear "K" (57) and said three planetary gears (59) to rotate therewith, a plurality of positioning stubs (611) secured on a periphery of said annular rack (61) to rotate therewith;

a curved rotary doll (62) secured on said annular rack (61) to rotate therewith and defining a plurality of positioning holes (621) for securing said positioning stubs (611) of said annular rack (61) therein;

an annular decorative plate (63) secured on said scenic base (4) and located outside of said annular rack (61), said decorative plate (63) having a periphery defining a plurality of screw holes (631) co-operating with a plurality of threaded locking members (632) for securing said decorative plate (63) to said scenic base (4);

a circular platform (64) secured on said scenic base (4) for enclosing said second actuating set (5) and located inside of said annular rack (61), said platform (64) defining two substantially S-shaped guide slots (642) for slidably receiving said upright rod (5821) of each of said two swing arms (582) of said second actuating set (5) therein, a plurality of threaded posts (641) each secured on a bottom of said platform (64) for securing said platform (64) to said scenic base (4); and two slidable dolls (65) each slidably mounted on said platform (64) and each having a bottom defining a fitting hole (651), two fitting rings (652) each secured in said fitting hole (651) of each of said two slidable dolls (65) and each fitted on said upright rod (5821) of each of said two swing arms (582) of said second actuating set (5) so that each of said two slidable dolls (65) is secured on said upright rod (5821) of each of said two swing arms (582) of said second actuating set (5) to slide therewith;

said housing (7) is mounted above said scenic base (4) for fitting of said winding article (1) and includes:

a semi-conic rear hood (71) secured on said scenic base (4) and having a top provided with a flange (711), said rear hood (71) having two opposite sides each having an upper portion and a lower portion each provided with a first pivot ear (712); and two front hoods (72) pivotally mounted on said two opposite sides of said rear hood (71) to form an entire hollow cone, each of said two front hoods (72) having one side having an upper portion and a lower portion each provided with two spaced second pivot ears (721) for receiving said first pivot ear (712) of said rear hood (71) therebetween, a plurality of latch rods (722) each extending through said second pivot ears (721) of each of said two front hoods (72) and through said first pivot ear (712) of said rear hood (71) so that each of said two front hoods (72) is pivotally mounted on said rear hood (71), said second pivot ear (721) located at said lower portion of each of said two front hoods (72) having a bottom secured with a linking lever (723) which has a distal end pivotally mounted on said second end of each of said two driving levers (333) of said first actuating set (3); and said top hood (8) is cone-shaped and has a bottom secured on said flange (711) of said rear hood (71) of said housing (7), said top hood (8) has an outer periphery provided with a plurality of elongated ribs (82) each defining a plurality of holes (821) for allowing passage of said winding article (1), an embedded lamp (81) mounted in said top hood (8), and a lighting decoration (83) mounted on a top of said top hood (8).

* * * * *